US006332328B1

(12) United States Patent
Bangheri

(10) Patent No.: US 6,332,328 B1
(45) Date of Patent: Dec. 25, 2001

(54) ABSORPTION HEAT PUMP AND PROCESS FOR OPERATION OF AN ABSORPTION HEAT PUMP

(75) Inventor: Andreas Bangheri, Brixlegg (AT)

(73) Assignee: Heliotherm Solartechnik Ges.m.b.H., Langkampfen/Tiro (AT)

( * ) Notice: Subject to any disclaimer, the term of this patent is extended or adjusted under 35 U.S.C. 154(b) by 0 days.

(21) Appl. No.: 09/547,717

(22) Filed: Apr. 11, 2000

(30) Foreign Application Priority Data

Apr. 14, 1999 (DE) ..... 199 16 907

(51) Int. Cl.[7] ..... F25B 15/00
(52) U.S. Cl. ..... 62/148; 62/141
(58) Field of Search ..... 62/148, 141

(56) References Cited

U.S. PATENT DOCUMENTS 3,837,174 * 9/1974 Miyagi et al. ..... 62/141
4,894,998 * 1/1990 Kaneko et al. ..... 62/148
5,289,868 * 3/1994 Koseki et al. ..... 165/14
5,619,859 * 4/1997 Takigawa et al. ..... 62/148
5,916,251 * 6/1999 Sibik ..... 62/148

* cited by examiner

*Primary Examiner*—Henry Bennett
*Assistant Examiner*—Mark Shulman
(74) *Attorney, Agent, or Firm*—Nixon Peabody LLP; David S. Safran

(57) ABSTRACT

A process for operation of an absorption heat pump in which in a boiling apparatus a solution which contains a refrigerant is heated by a burner in order to expel the refrigerant as refrigerant vapor; the refrigerant vapor is condensed in a condenser by interaction with a heat transfer medium; the refrigerant from the condenser is supplied to a vaporizer and an absorber; the solution which has been depleted of refrigerant from the boiling apparatus is supplied to the absorber; the solution which is rich in refrigerant from the absorber is pumped to a high pressure level and is returned to the boiling apparatus; and the heat transfer medium which has been heated in the condenser is supplied to a consumer and the heat transfer medium which has been cooled by the consumer is returned to the condenser is improved by measuring the outside temperature and the temperature of the heat transfer medium and adjusting the output of the burner depending on the measured temperature values, and by controlling the amount of the refrigerant supplied to the vaporizer, the amount of the solution which has been depleted of refrigerant and which is supplied to the absorber, and the delivery amount of the solution pump.

34 Claims, 8 Drawing Sheets

ABSORPTION HEAT PUMP AND PROCESS FOR OPERATION OF AN ABSORPTION HEAT PUMP

BACKGROUND OF THE INVENTION

1. Field of the Invention

This invention relates to an absorption heat pump and a process for operation of an absorption heat pump.

2. Description of Related Art

In absorption heat pump systems, a solution which contains a refrigerant is heated in a boiling apparatus, for example, by means of a gas burner or oil burner, electrically or also with the aid of additional heat exchangers by means of exhaust heat or solar energy, in order to drive the refrigerant as refrigerant vapor out of the solution. The refrigerant vapor is brought by this process to a high temperature level and high pressure level. The refrigerant vapor is then condensed in a condenser against a heating agent, and thus, supplies heat to the heating agent. The highly cooled and expanded refrigerant is supplied to a vaporizer in which it is vaporized against a medium which supplies ambient energy to the refrigerant and is then supplied to at least one absorber.

The solution which has been depleted of refrigerant from the boiling apparatus is supplied via a heat exchanger to the absorber where the solution which has been depleted of coolant is combined with the refrigerant which has passed through the vaporizer. The resulting solution heat is made available to the expulsion process and the consumer or is channeled only to the consumer. The resulting solution, which is rich in refrigerant from the absorber, is pumped to a high pressure level by means of a solution pump from the low pressure level of the absorber, which corresponds roughly to the vaporization pressure, and is supplied again to the boiling apparatus. Finally, the heating agent which has been heated in the condenser is supplied to a consumer and the heating agent which has been cooled by the consumer is returned to the condenser.

If, in an absorption heat pump system, the heating of the boiling apparatus is turned off, the concentration stratification which prevails in the operation of the absorption heat pump in the boiling apparatus is broken down and brought to the level of the solution which is low in refrigerant. During a transient starting process, first by gradual supply of the rich solution, the concentration stratification which is necessary for steady-state operation in the boiling apparatus can be built up. After the boiling apparatus is turned off, therefore, in the restarting of this system considerable starting time and energy losses must be tolerated.

To overcome these problems, European Patent Application EP-B-0 202 432 and its counterpart U.S. Pat. No. 4,718,243 propose a cycling absorption heat pump system in which the high pressure part and the low pressure part, at standstill, are blocked by solenoid valves in order to minimize the restart losses. The defect in this technology is that, when the burner output is changed, which can be caused for example by temperature fluctuations, heat pump operation is not always ensured.

SUMMARY OF THE INVENTION

Therefore, a primary object of the present invention is to devise an absorption heat pump and a process for operation of the absorption heat pump of the initially mentioned type in which the energy losses which occur during start-up of the absorption heat pump are minimized while reliable operation of the heat pump continues to be ensured.

This object is achieved, in a process for operation of an absorption heat pump which is based on that of European Application EP-B-0 202 432 and U.S. Pat. No. 4,718,243, by the outside temperature and the temperature of the heating agent being measured and the power of the burner set depending on the measured temperature values, the amount of refrigerant supplied to the vaporizer being regulated, the amount of solution which has been depleted of refrigerant and which is supplied to at least one absorber regulated, and furthermore the delivery amount of the solution pump also regulated.

Accordingly this object is furthermore achieved, in an absorption heat pump which is based on that of European Application EP-B-0 202 432 and U.S. Pat. No. 4,718,243, by the following being provided: a first control means which comprises an outside sensor which is located in the open for measuring the outside temperature, at least one heating agent sensor for measuring the temperature of the heating agent, and a first controller for controlling the output of the burner depending on the measured temperature values, a second control means for controlling the amount of the refrigerant supplied to the vaporizer, a third control means for controlling the amount of solution which has been depleted of refrigerant and which is supplied to at least one absorber, and a fourth control means for controlling the delivery amount of the solution pump.

The approach in accordance with the invention enables modulating operation of the absorption heat pump by means of these control circuits so as to minimize transient start-up losses while, at the same time, reliable heat pump operation is ensured. Cycled operation as is provided in the systems proposed in the prior art is prohibited by the modulating technology.

For reasons of clarity, the control processes which are involved in the concept according to invention, i.e., burner control, condenser choke control, solution choke control and solution pump control, are described separately. However, it goes without saying that, in the process and apparatus in accordance with the invention all four of these control processes are implemented at the same time.

These and further objects, features and advantages of the present invention will become apparent from the following description when taken in connection with the accompanying drawings which, for purposes of illustration only, show several embodiments in accordance with the present invention.

DETAILED DESCRIPTION OF THE INVENTION

Figure 1:
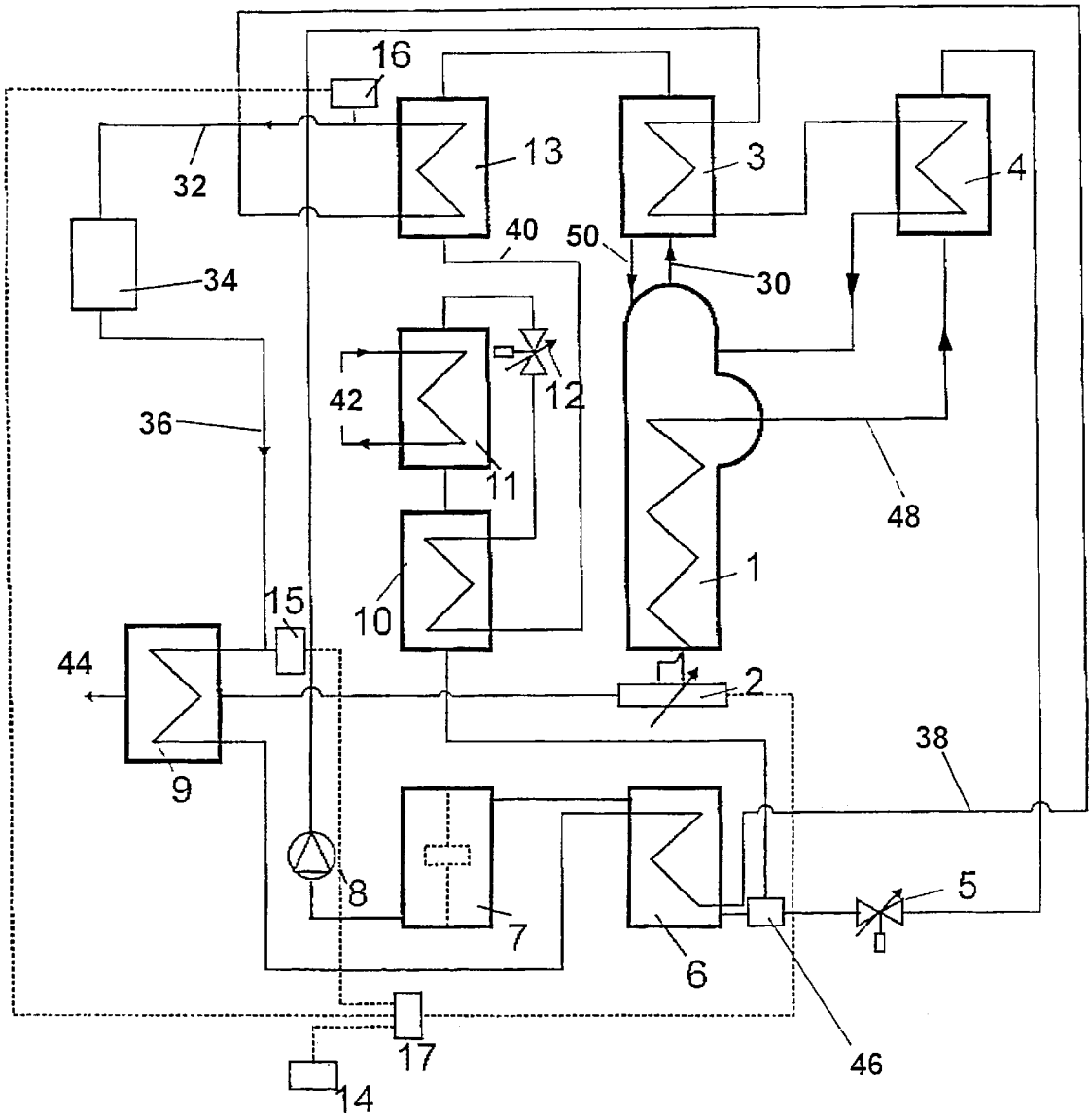
FIG. 1 shows a schematic of the structure of an absorption heat pump and burner control which is used in accordance with the invention.

As is shown schematically in FIG. 1, an absorption heat pump comprises a boiling apparatus or expeller 1 in which, by means of a burner 2, a solution containing a refrigerant is heated to drive the refrigerant out of the solution as refrigerant vapor. In the embodiment as shown in FIG. 1, the refrigerant vapor is supplied in a line 30 via a rectifier 3 to a condenser 13 in which the refrigerant vapor is condensed by interaction with a heat transfer medium. The heat transfer medium which has been heated in this way is, in turn, supplied in a line 32, the so-called supply, to a consumer 34, for example, a radiator.

Heat transfer medium which has passed the consumer 34 travels via a line 36, the so-called return, back to the absorption heat pump. In particular, the heat transfer medium which has been cooled in the consumer 34 can be heated in an exhaust gas heat exchanger 9 by interaction with hot exhaust gas which emerges from the burner 2 and which is released into the atmosphere at 44 or in some other way disposed of or processed before it is supplied to an absorber 6. After passing through the absorber 6, which can be a plate heat exchanger, for example, the heat transfer medium is supplied again in a line 38 to the condenser 13 so that a closed heat transfer medium circuit results.

The refrigerant which has been expanded and greatly cooled down in the condenser 13, by interaction with the heat transfer medium which is being heated, is supplied in a line 40 to an aftercooler 10 from which it is supplied via a choke site 12 to a vaporizer 11 . In the vaporizer 11, ambient energy is supplied to the refrigerant, and here in particular, it can be heat which is stored in the environment of a building (represented in FIG. 1 by 42) which is to be heated by the consumer 34, i.e., in the earth, in water, in air, especially in brine.

Refrigerant which leaves the vaporizer 11 is routed again through the aftercooler 10 and from there to the absorber 6. In the absorber 6 or, as is shown in FIG. 1, in a mixer 46 which is located in front of the absorber, the refrigerant is mixed with solvent which has left the boiling apparatus 1 via a line 48. The resulting solution heat is made available to the expeller process in the boiling apparatus 1 and the consumer 34 or is channeled only to the consumer 34. The solution which is high in refrigerant and which leaves the absorber 6 is pumped to a high pressure level after passing the solution storage tank 7 by means of a solution pump 8 from the low pressure level of the absorber 6, which corresponds roughly to the vaporization pressure, and is returned to the boiling apparatus 1. Here, the solution which is rich in refrigerant can be routed from the absorber 6, as shown in FIG. 1, via the rectifier 3 and a heat exchanger 4 in which the solution rich in refrigerant is subjected to heat exchange with the refrigerant vapor leaving the boiling apparatus 1 or the solvent leaving the boiling apparatus 1. The refrigerant which is condensed in the rectifier 3 is supplied to the boiling apparatus 1, again via a return 50.

The general structure of this absorption heat pump described here is common to all the embodiments described below and is therefore not described again in the description of the other drawings. The following description is focused mainly on the individual control aspects of the concept according to the invention. As already mentioned, in the individual drawings, not all control aspects are shown at the same time, but the burner control, the condensate choke control, the solution choke control and the solution pump control are explained in succession using partial schematic drawings.

With reference to FIG. 1, first the components relating to burner control are described. The object of the absorption heat pump burner control is to achieve burner output control which is matched to the heat demand of the building to be heated in order to ensure continuous operation of the absorption heat pump. The concept described here is based, differently than the initially described known system based on the knowledge that, with suitable control of the system, it is perfectly reasonable and energy-saving not to entirely turn off the absorption heat pump when the heat demand has been reduced, but to turn it down since the losses which occur otherwise in a repeated start-up of the system prevail over the energy savings achieved by turning it off.

In the means as shown in FIG. 1, there are an external sensor 14 for measuring the ambient temperature and a heat transfer medium sensor for measuring the temperature of the heat transfer medium, and the heat transfer medium sensor can be made as a return sensor 15 for acquiring the return temperature or as a supply sensor 16 for acquiring the return temperature. The external sensor 14 and the return sensor 15 and/or the supply sensor 16 are connected to a controller 17 with an output which is connected to the burner 2. The burner 2 is a controllable burner with a power consumption of, for example, 4 to 18 kW. The controller 17 compares the measured return or supply temperature with a setpoint and chokes the burner output as the return or supply temperature approaches the setpoint. Control can take place here according to preset heating curves. Thus, on the one hand, the burner output can be related directly to the measured outside temperature by assigning certain values for the power consumption of the burner to certain outside temperature values. Thus, for example, a burner power of 4 kW can be assigned to an outside temperature of +15° C., while at an outside temperature of −15° C. the burner output will be 13 kW. However, the supply and/or the return temperature can also be used as the adjustment parameters for the output of the burner. Thus, for example, a return temperature of 25° C. can be assigned to an outside temperature of +15° C., while a return temperature of 45° C. is assigned to an outside temperature of −15° C. In addition to comparing the setpoint and the actual value of the supply and return temperature, the temperature spread of the heat transfer medium, i.e., the difference between the supply and return temperature, can be used as the control parameters. These types of control can be implemented here individual or jointly. The described burner control thus matches all the heat energy produced by the absorption process by modulating it to the heat demand of the building to be heated which can be continually changed, for example, by individual settings (for example, the heating elements are closed) or also by outside action (variation of incident solar radiation, etc.).

In order to ensure condensation of the refrigerant in the condenser over all modulating heat pump operation in the above described modulating burner control, according to the concept described here the condensate choke is controlled. The condensate choke control is also designed to avoid an unnecessarily high condensation pressure and thus contributes to an improvement of the overall efficiency.

Figure 2:
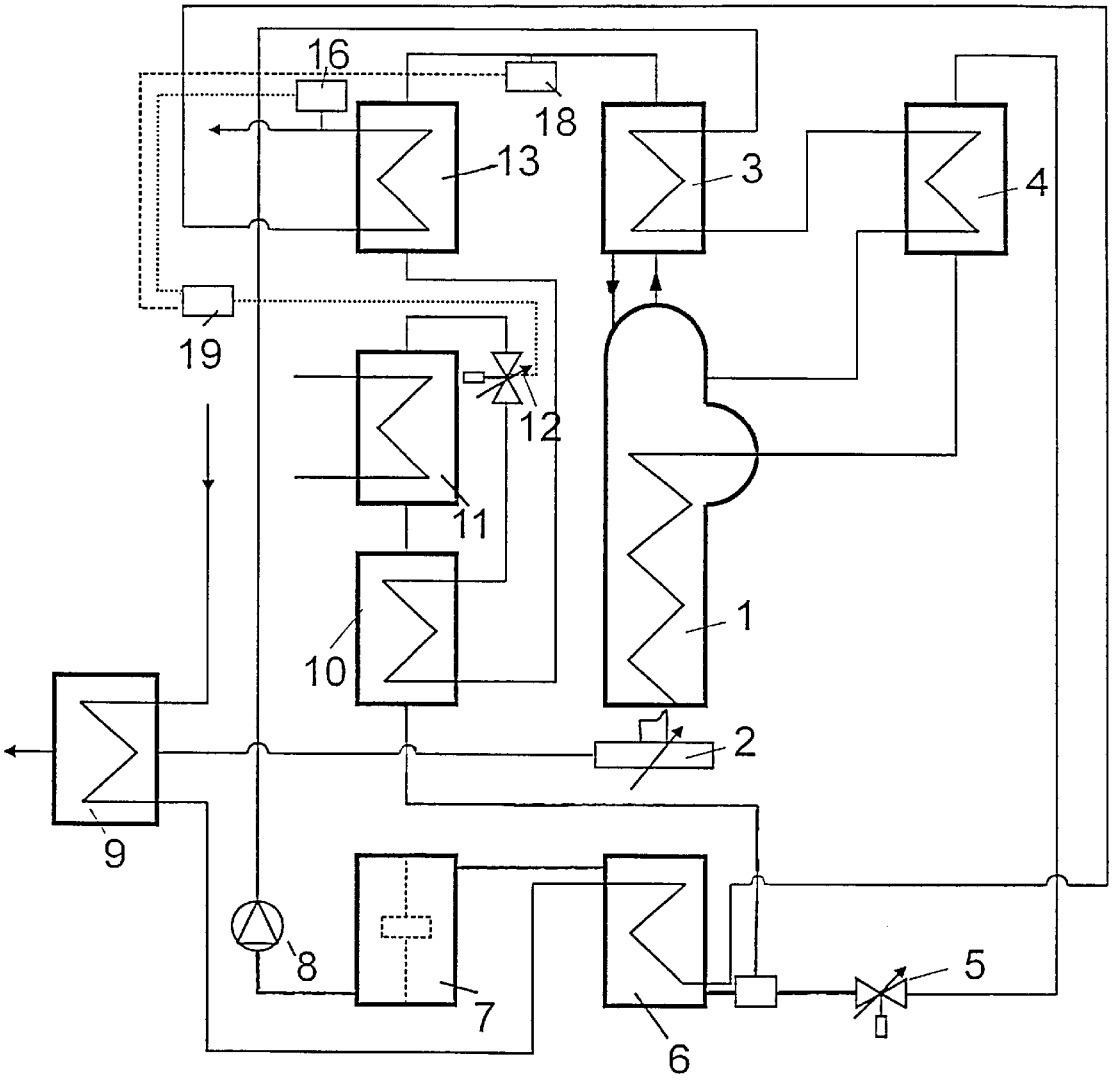
FIGS. 2 to 4 each show a representation similar to FIG. 1 in which a respective embodiment using the condensate choke control according to the absorption heat pump concept described here.

As is explained below with reference to FIGS. 2 to 4 in particular, the condensate choke can be accomplished with the aid of several different control parameters. In particular, the pressure $P_{rcin}$ of the refrigerant vapor entering the condenser 13 can be measured by means of a pressure sensor 18 as is illustrated in FIG. 2. This pressure value $P_{rcin}$ can be converted with the aid of the fundamental equation of Ziegler (which is known to those skilled in the art) into a temperature value $T_{rcin}$. By means of a controller 19, in the example shown, a proportional integral differential controller (PID), then, the temperature value $T_{rcin}$ computed in this way is compared to a reference temperature in order to form an output signal for triggering a continuously controllable adjustment element. In the embodiment shown in FIG. 2, the reference temperature is the temperature $T_{supply}$ of the heat transfer medium emerging from the condenser 13 which has been measured by means of a temperature sensor 16. If the temperature difference $T_{rcin}-T_{supply}$ is less than a stipulated setpoint, for example, 1 to 4K, the amount of refrigerant supplied to the vaporizer 11 is reduced by means of the To controllable choke point 12 which can be made, for example, as a pulse width-modulated valve. Conversely, if the indicated temperature difference is greater than the stipulated setpoint, the amount of refrigerant supplied to the vaporizer 11 is increased. By means of the setpoint, it is ensured that there is always condensate undercooling of roughly 2 to 5 K. If the difference $T_{rcin}-T_{supply}$ is equal to the stipulated setpoint, the valve setting is optimum.

Figure 3:
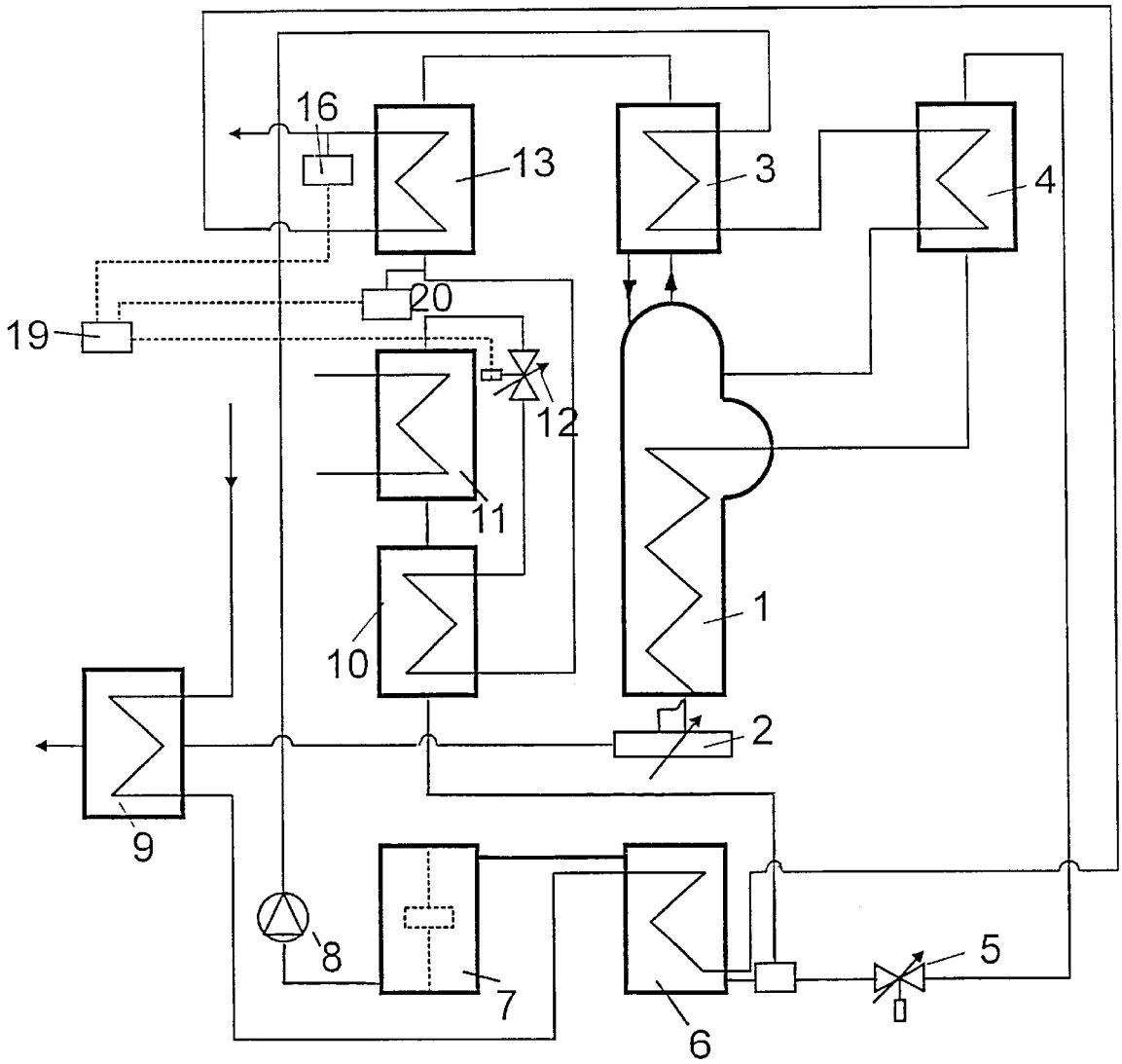

One version of the condensate choke control from FIG. 2 is shown in FIG. 3. Instead of the pressure sensor 18 (FIG. 2), there is a temperature sensor 20 here which acquires the temperature $T_{rcout}$ of the refrigerant emerging from the condenser 13. This temperature $T_{rcout}$ is, in turn, compared to the temperature $T_{supply}$ of the heat transfer medium emerging from the condenser 13. Using the temperature difference which has been determined with the controller 19 between the supply temperature $T_{supply}$ which corresponds to the condensation temperature and the temperature $T_{rcout}$ of the condensate, the prevailing condensate undercooling can be evaluated. If a setpoint is stipulated for condensate undercooling, the choke point 12 can be entirely or partially opened or closed based on a comparison between the indicated temperature difference and this setpoint. The setpoint of condensate undercooling is preferably in the range between 2 and 5 K.

Figure 4:
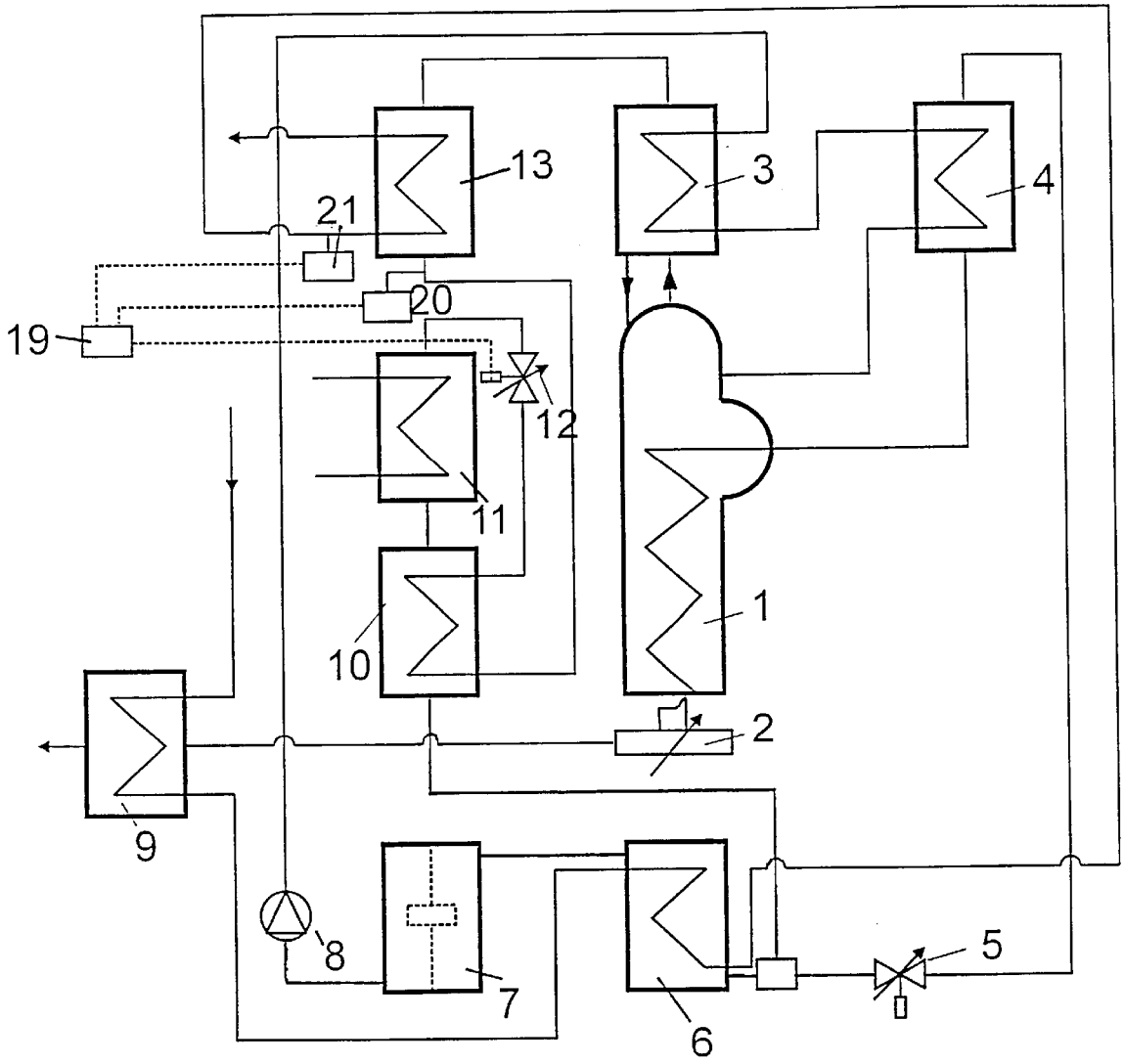

Another version of the condensate choke control from FIG. 2 is shown in FIG. 4. The embodiment of FIG. 4 differs from that of FIG. 3 in that the temperature of the heat transfer medium is not measured at the outlet of the condenser 13, but at its inlet. The temperature $T_{rcout}$, measured by means of a temperature sensor 20, of the refrigerant emerging from the condenser 14 is then compared to the temperature $T_{hcin}$ of the heat transfer medium entering the condenser 13 which is measured by means of a temperature sensor 21, for this purpose the controller 19 preferably comprises a subtraction element. As in the above embodiments, the temperature difference resulting from the comparison of the two indicated temperatures can, in turn, be compared to a setpoint and the choke point can be controlled depending on this comparison.

Figure 5:
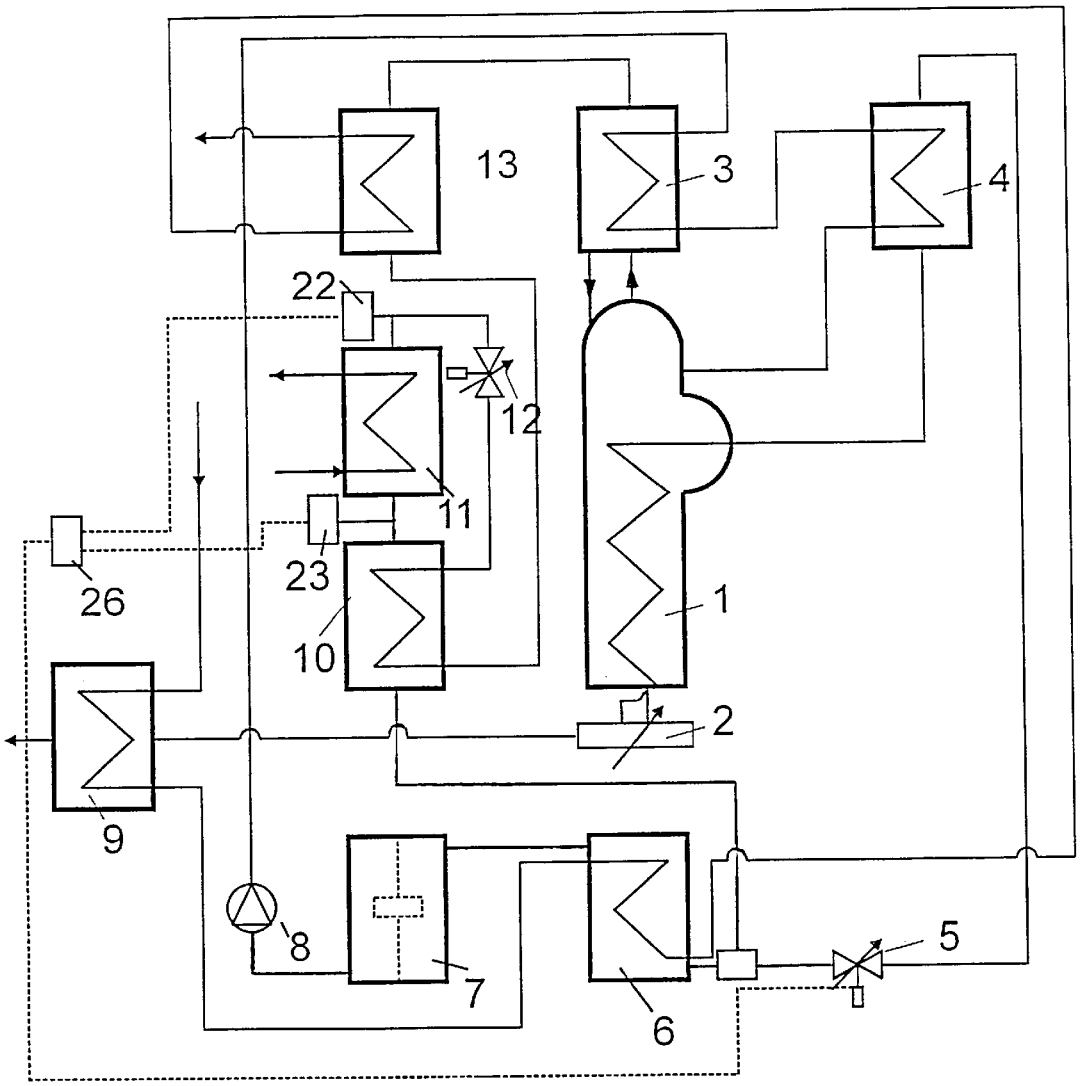
FIGS. 5 to 7 each show a representation similar to FIG. 1 in which a respective embodiment using the solution choke control according to the absorption heat pump concept described here.
Figure 6:
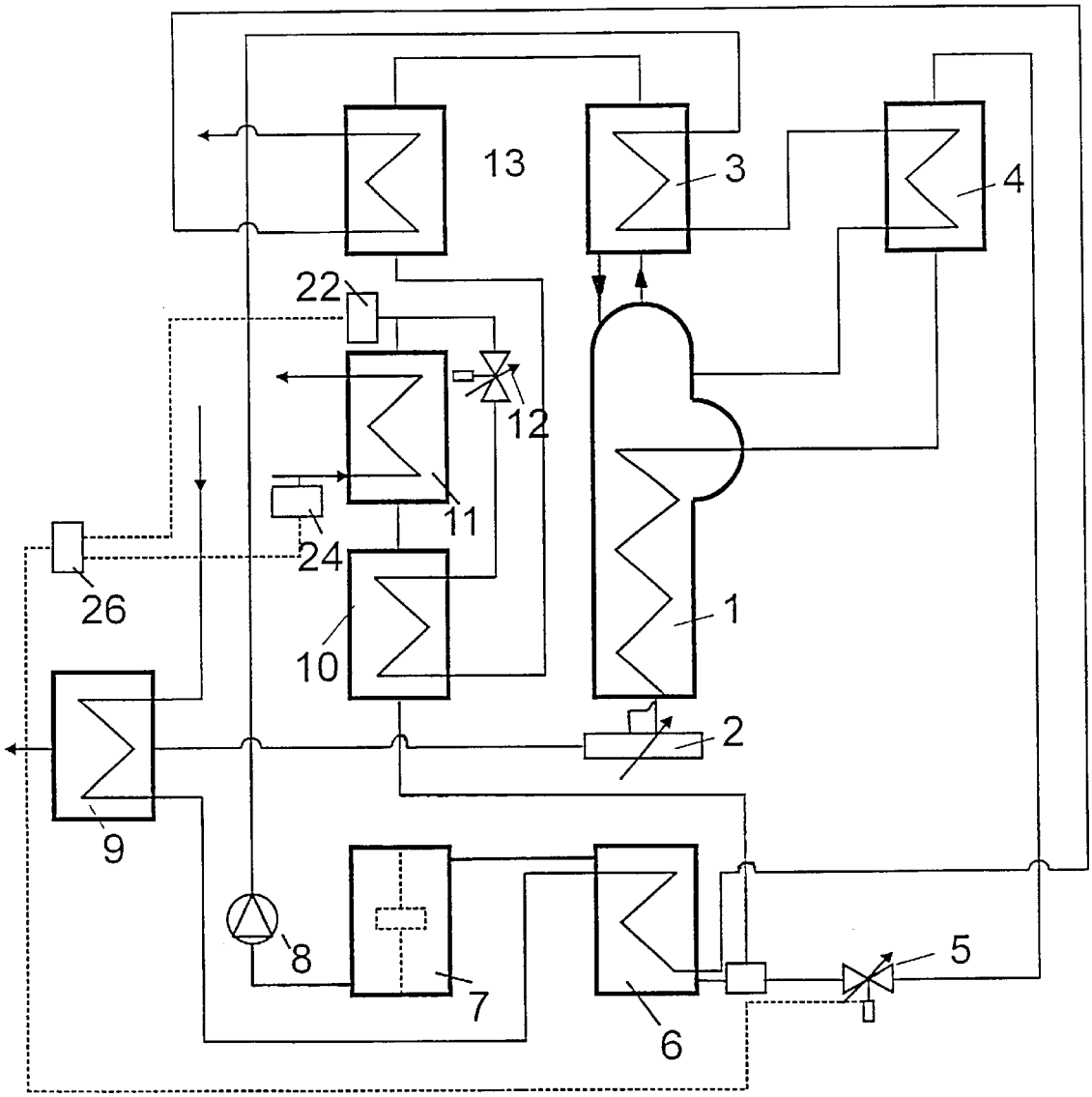
Figure 7:
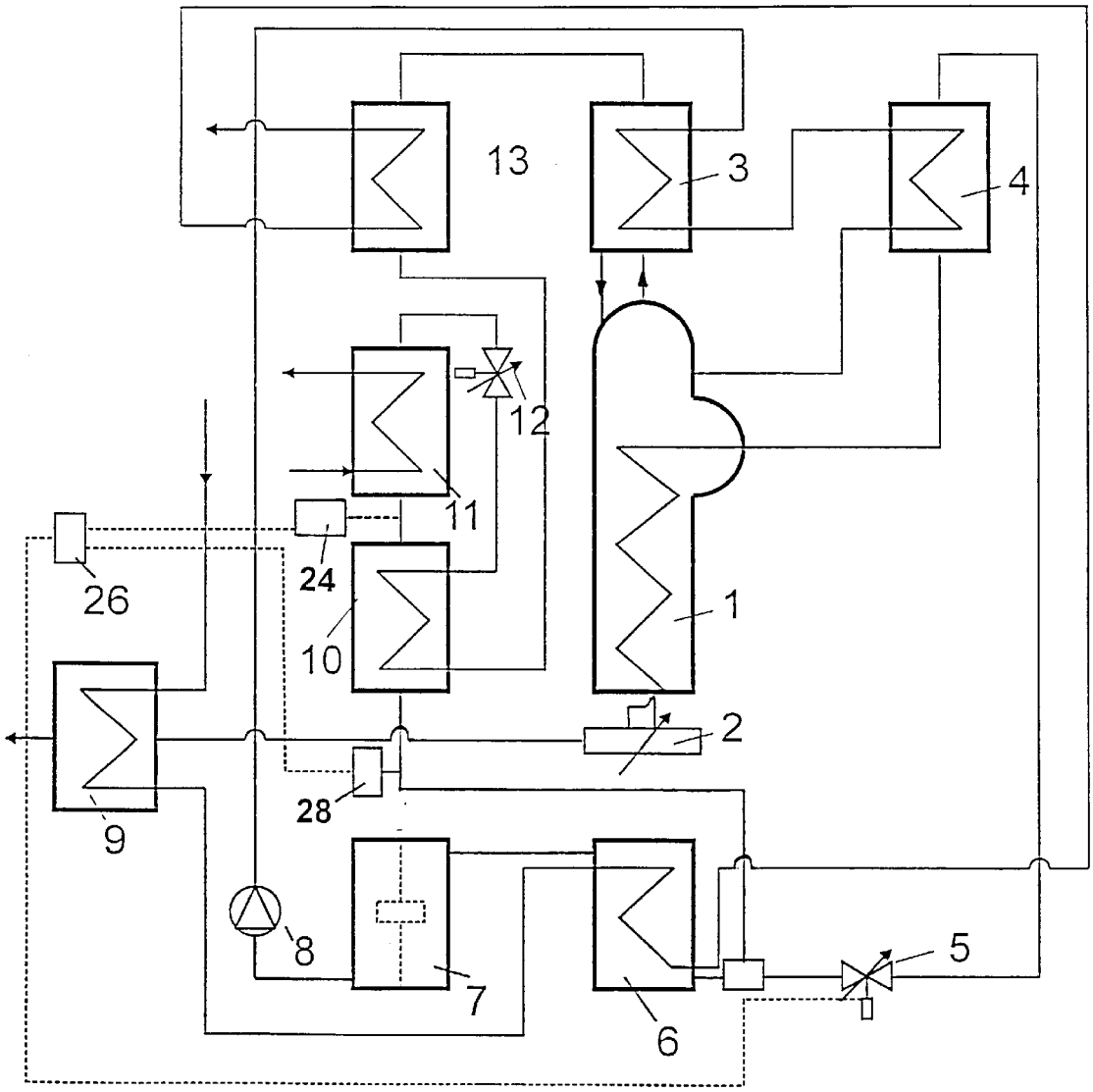

With reference to FIGS. 5 to 7, the solution choke control which is used in this absorption heat pump concept is explained below. The solution choke 5 which is shown in the drawings determines the flow of solution which is low in refrigerant, which is discharged from the boiling apparatus 1 via the heat exchanger 4, and which is mixed in the mixer 46 (FIG. 1) with the refrigerant emerging from the aftercooler 10 before it is routed into the absorber 6. By adjusting the choke control 5, the absorber which is operated at low pressure and the vaporization pressure are influenced. The object of this control is to keep the low pressure in any operating state of the heat pump such that the vaporizer 11 absorbs the maximum possible energy, and at the same time, it is ensured that an unnecessarily high mass flow of the solution which is low in refrigerant does not arise. When the solution choke 5 is opened, this has a series of effects.

- the flow and thus the concentration of solution which is low in refrigerant increases,
- the specific solution circulation becomes larger,
- the solution field is further compressed,
- the concentration difference and thus also the temperature difference between the boiler foot and the boiler head of the boiling apparatus is reduced,
- the concentration of "rich" solution in the absorber becomes less,
- the low pressure drops.

Closing of the solution choke has accordingly the opposite effects.

According to FIG. 5, a temperature sensor 22 measures the temperature $T_{rvin}$ of the refrigerant supplied to the vaporizer 11. Using a second temperature sensor 23 the temperature $T_{rcout}$ of the refrigerant emerging from the vaporizer 11 is acquired. A PID controller 26 forms, from the two measured temperature values, a difference and based on the result of finding the difference, applies an actuating signal to the solution choke 5. In particular, the determined temperature difference is compared, similarly as in the above described process, to a stipulated setpoint, in the embodiment described here one especially preferred range for this setpoint extending from 7 to 10 K. If the ascertained temperature difference is greater than the stipulated setpoint, the solution choke 5 will open; if the ascertained temperature difference is less than the stipulated setpoint, the solution choke 5 will close. The control of the solution choke 5 can, moreover, also be influenced by the measurement of the supply temperature, as was explained with reference to FIGS. 2 and 3, by varying the setpoint for the difference between the temperature $T_{rvin}$ of the refrigerant supplied to the vaporizer 11 and the temperature $T_{rvout}$ of the refrigerant emerging from the vaporizer 11 depending on the supply temperature $T_{supply}$. For example, control can be set up such that the setpoint for the indicated temperature difference at the vaporizer at a supply temperature of 30° C. is, for example, 14 K, while this setpoint at a supply temperature of 50° C. is reduced, for example, to 7 K.

In the version of the solution choke control shown in FIG. 6, according to FIG. 5, the temperature $T_{rvin}$ of the refrigerant supplied to the vaporizer 11 which has been measured by means of the temperature sensor 22 is compared to the temperature $T_{mvin}$ of the medium (brine, water, air, etc) supplied to the vaporizer 11 which has been measured by means of the temperature sensor 24. Based on this comparison, the controller 26 delivers an actuating signal to the solution choke 5 depending on a stipulated setpoint.

Another version of the solution choke control is shown in FIG. 7, here by means of a pressure transducer 28 the pressure $p_{rvin}$ of the refrigerant emerging from the aftercooler 10 and by means of a temperature sensor 24 the temperature $T_{rvout}$ of the refrigerant emerging form the vaporizer 11 being measured. The measured pressure value, similarly to as described above with reference to the condensate choke control used here, can be converted into a temperature value and compared to the temperature value measured by means of the temperature sensor 24 by finding the difference. The temperature difference which has been determined in this way is then compared to a stipulated setpoint in order to obtain a control signal for the choke control 5. The arrangement of the pressure transducer 28 and of the temperature sensor 24 which is shown in FIG. 7 could furthermore by modified such that the two transducers be located at essentially the same point in the process. In particular, both the pressure transducer 28 as well as the temperature sensor 24 could be placed between the aftercooler 10 and the mixer 46 or between the vaporizer 11 and the aftercooler 10.

Figure 8:
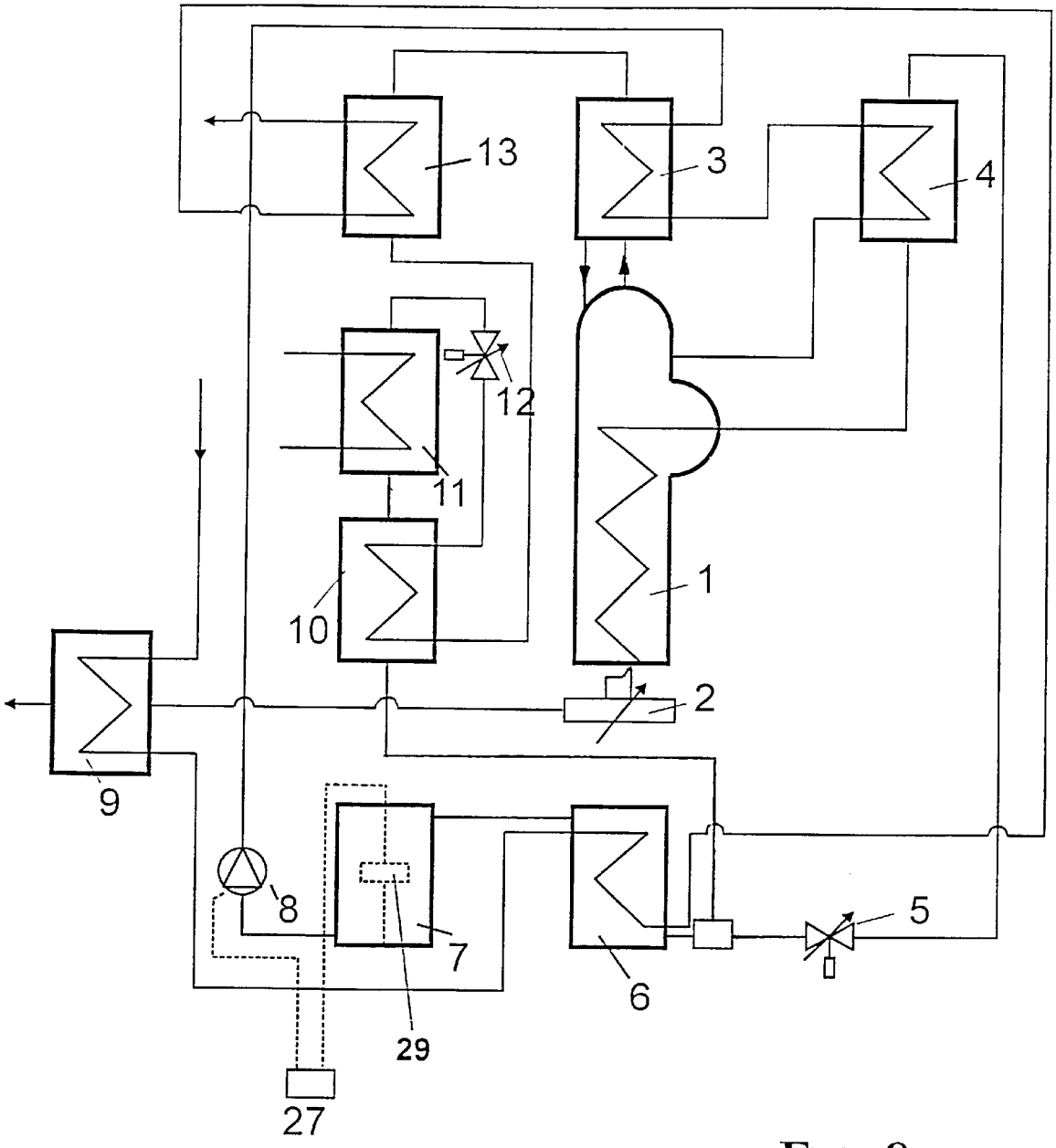
FIG. 8 is a representation similar to FIG. 1 in which an embodiment of the solution pump control used according to the absorption heat pump concept described here is illustrated.

FIG. 8 shows one embodiment of the solution pump control which is used in this absorption heat pump concept.

As was explained with reference to FIG. 1, the solution which is rich in refrigerant and which leaves the absorber 6 is pumped from the low pressure level of the absorber 6 to a high pressure level after passing, the solution storage tank 7 by means of a solution pump 8 and is returned to the boiling apparatus 1. In the embodiment of solution pump control which is shown in FIG. 8, by means of a float 29 which is located in the solution storage tank 7, advantageously a magnetically inductive float, the fill level of the solution storage tank 7 is acquired, and based on the measured fill level, the rpm of the solution pump 8, and thus, the solution mass flow are matched to the process.

While various embodiments in accordance with the present invention have been shown and described, it is understood that the invention is not limited thereto, and is susceptible to numerous changes and modifications as known to those skilled in the art. Therefore, this invention is not limited to the details shown and described herein, and includes all such changes and modifications as are encompassed by the scope of the appended claims.

What is claimed is:

1. Process for operating an absorption heat pump in which (a) heating a solution which contains a refrigerant in a boiling, apparatus by means of a burner in order to expel the refrigerant as refrigerant vapor and produce a solution which has been depleted of refrigerant;

(b) condensing the refrigerant vapor in a condenser by interaction with a heat transfer medium in order to supply heat to the heat transfer medium;

(c) supplying the refrigerant from the condenser to a vaporizer in which it is vaporized by interaction with a medium, and then, to at least one absorber, (d) supplying the solution which has been depleted of refrigerant from the boiling apparatus, via a heat exchanger, to at least one absorber where the solution which has been depleted of refrigerant is combined with refrigerant which has passed through the vaporizer to form a solution which is rich in refrigerant;

(e) pumping the solution which is rich in refrigerant from the absorber, by means of a solution pump, to a high pressure level and returning the refrigerant to the boiling apparatus; and (f) supplying the heat transfer medium which has been heated in the condenser to a consumer and returning the heat transfer medium, which has been cooled by the consumer, to the condenser, wherein (g) an outside temperature and a temperature of the heat transfer medium are measured and burner output is adjusted depending on the measured temperature values;

(h) the amount of the refrigerant supplied to the vaporizer is controlled;

(i) the amount of solution which has been depleted of refrigerant and which is supplied to at least one absorber is controlled; and (j) the delivery amount of the solution pump is controlled.

2. Process as claimed in claim 1, wherein the refrigerant emerging form the condenser is brought into indirect heat exchange with the refrigerant which is emerging from the vaporizer before it is supplied to the vaporizer.

3. Process as claimed in claim 1, wherein a return temperature ($T_{return}$) of the heat transfer medium is measured after passing through the consumer.

4. Process as claimed in claim 3, wherein the return temperature ($T_{return}$) is measured repeatedly and the measured value of the return temperature is compared to a setpoint; and wherein the burner output is choked as the measured value of the return temperature approaches the setpoint of the return temperature.

5. Process as claimed in claim 1, wherein a supply temperature ($T_{supply}$) of the heat transfer medium which is supplied to the consumer from the condenser is measured.

6. Process as claimed in claim 5, wherein the supply temperature ($T_{supply}$)is repeatedly measured and the measured value of the supply temperature is compared to a setpoint; and wherein the burner output is choked as the measured value of the supply temperature approaches the setpoint of the supply temperature.

7. Process as claimed in claim 1, wherein a return temperature ($T_{return}$) of the heat transfer medium after passing through the consumer and a supply temperature ($T_{supply}$) of the heat transfer medium which is supplied to the consumer from the condenser are repeatedly measured; wherein, for each measurement, a difference is found from the measured values of the supply temperature and the return temperature; and wherein burner output is choked when the difference in one measurement is less than in a preceding measurement.

8. Process as claimed in claim 1, wherein the outside temperature ($T_A$) is repeatedly measured and the burner output is increased as the outside temperature decreases.

9. Process as claimed in claim 1, wherein a pressure $p_{rcin}$ of the refrigerant entering the condenser and a supply temperature ($T_{supply}$) of the heat transfer medium emerging from the condenser are measured; and the amount of the refrigerant supplied to the vaporizer is adjusted depending on the measured pressure and temperature values ($p_{rcin}$, $T_{supply}$).

10. Process as claimed in claim 9, wherein the measured pressure value ($p_{rcin}$) is converted into a temperature value ($T_{rcin}$) and by means of the temperature value obtained (in Kelvin) and the supply temperature (in Kelvin), an actuating value A is computed according to the formula $$A=T_{rcin}-T_{supply}-B$$

where B has a value between 0.5 and 10 K; and wherein the amount of the refrigerant supplied to the vaporizer is increased when A is greater than zero; and the amount of the refrigerant supplied to the vaporizer is reduced when A is less than zero.

11. Process as claimed in claim 1, wherein a temperature ($T_{rcout}$) of the refrigerant emerging from the condenser and a temperature ($T_{supply}$) of the heat transfer medium emerging from the condenser are measured; and a choke point of the condensate valve is set depending on the measured temperature values ($T_{rcout}$, $T_{supply}$).

12. Process as claimed in claim 11 , wherein an actuating value C is obtained from the difference of the measured temperature values according to the formula:

$$C=(T_{supply})-T_{rcout})-D$$

where D is a setpoint having a value between 1 and 10 K; and wherein the amount of the refrigerant supplied to the vaporizer is increased when C is greater than zero; and wherein the amount of the refrigerant supplied to the vaporizer is reduced when C is less than zero.

13. Process as claimed in claim 1, wherein the temperature ($T_{rcout}$) of the refrigerant emerging from the condenser and the temperature ($T_{hcin}$) of the heat transfer medium entering the condenser are measured; and wherein a choke point of the condensate valve is adjusted depending on the measured temperature values ($T_{rcout}$, $T_{hcin}$).

14. Process as claimed in claim 13, wherein the difference of the measured temperature ($T_{rcout}$) of the refrigerant emerging from the condenser and the temperature ($T_{hcin}$) of the heat transfer medium entering the condenser is computed; and wherein the choke point is adjusted depending on the computed difference.

15. Process as claimed in claim 14, wherein the measurements and computations are carried out repeatedly and an opening area of the choke point is made smaller when the temperature difference increases and is made larger when the temperature difference decreases.

16. Process as claimed in claim 1, wherein a supply temperature ($T_{rvin}$) of the refrigerant supplied to the vaporizer and the temperature ($T_{rvout}$) of the refrigerant emerging from the vaporizer are measured; and wherein the amount of the solution which has been depleted of refrigerant and which is supplied to at least one absorber is adjusted depending on the measured temperature values ($T_{rvin}$, $T_{rvout}$).

17. Process as claimed in claim 16, wherein an actuating value E is obtained from a difference of the measured temperature values ($T_{rvin}$, $T_{rvout}$) as compared to a setpoint F according to the formula:

$$E=(T_{rvin}-T_{rvout})-F$$

and wherein the amount of the solution which has been depleted of refrigerant and which is supplied to at least one absorber is increased when E is greater than zero; and wherein the amount of the solution which has been depleted of refrigerant and which is supplied to at least one absorber is reduced when E is less than zero.

18. Process as claimed in claim 1, wherein the temperature ($T_{rvin}$) of the refrigerant supplied to the vaporizer and the temperature ($T_{mvin}$) of the medium supplied to the vaporizer are measured; and wherein the amount of the solution which has been depleted of refrigerant and which is supplied to at least one absorber is adjusted depending on the measured temperature values ($T_{rvin}$, $T_{mvin}$).

19. Process as claimed in claim 18, wherein an actuating value G is obtained from the difference of the measured temperature values ($T_{rvin}$, $T_{mvin}$) as compared to a setpoint H according to the formula:

$$G=(T_{mvin}-T_{rvin})-H$$

wherein the amount of the solution which has been depleted of refrigerant and which is supplied to at least one absorber is increased when G is greater than zero; and wherein the amount of the solution which has been depleted of refrigerant and which is supplied to at least one absorber is reduced when G is less than zero.

20. Process as claimed in claim 1, wherein a pressure ($P_{rvout}$) of the refrigerant emerging from the vaporizer and the temperature ($T_{rvout}$) of the refrigerant emerging from the vaporizer are measured; and wherein the amount of the solution which has been depleted of refrigerant and which is supplied to at least one absorber is adjusted depending on the measured pressure and temperature values ($p_{rvout}$, ($T_{rvout}$).

21. Process as claimed in claim 20, wherein the measured pressure value ($P_{rvout}$) is converted into a temperature value $T_{vaporization}$ and by means of the converted temperature value (in Kelvin) and the temperature ($T_{rvout}$) of the refrigerant emerging from the vapoizer, an actuating value L is computed according to the formula:

$$L=T_{vaporization}-T_{rvot}-M$$

M having a value between 4 and 15 K; and wherein the amount of the solution which has been depleted of refrigerant and which is supplied to at least one absorber is increased when L is less than zero; and wherein the amount of the solution which has been depleted of refrigerant and which is supplied to at least one absorber is reduced when L is greater than zero.

22. Process as claimed in claim 1, wherein the solution which is rich in refrigerant and which comes from the absorber is routed through a solution storage tank, the fill level in the solution storage tank is measured, and the delivery amount of the solution pump is adjusted depending on the measured fill level.

23. Absorption heat pump comprising:

(a) a boiling apparatus for holding a solution which contains a refrigerant;

(b) a burner for supplying heat to the boiling apparatus and producing refrigerant vapor;

(c) a condenser;

(d) a first line arrangement for transferring refrigerant vapor from the boiling apparatus to the condenser;

(e) a second line arrangement for transferring a heat transfer medium, which is heated in the condenser by means of condensing refrigerant vapor from the condenser, to a consumer and for returning the heat transfer medium, which has been cooled by the consumer, to the condenser;

(f) a vaporizer for vaporizing the refrigerant by interaction with a medium;

(g) a choke point and a third line arrangement for transferring the refrigerant from the condenser to the choke point and from the choke point to the vaporizer;

(h) at least one absorber and a fourth line arrangement for transferring refrigerant from the vaporizer to the absorber;

(i) a fifth line arrangement for transferring the solution which has been depleted of refrigerant in the boiling apparatus to at least one absorber;

(j) a solution pump for compressing the solution which is rich in refrigerant and which is diverted from the absorber to a high pressure level, and a sixth line arrangement for transferring the solution which is rich in refrigerant and which is at a high pressure level to the boiling apparatus;

(k) a first control means which comprises an outside sensor which is located in the open for measuring the outside temperature, at least one heat transfer medium sensor for measuring the temperature of the heat transfer medium, and a first controller for controlling the output of the burner depending on the measured temperature values, (l) a second control means for controlling the amount of the refrigerant supplied to the vaporizer;

(m) a third control means for controlling the amount of solution which has been depleted of refrigerant and which is supplied to at least one absorber; and (n) a fourth control means for controlling the delivery amount of the solution pump.

24. Absorption heat pump as claimed in claim 23, further comprising an aftercooler in which the refrigerant emerging from the condenser is brought into indirect heat exchange with the refrigerant which is emerging from the vaporizer before it is supplied to the vaporizer.

25. Absorption heat pump as claimed in claim 23, wherein the first control means comprises a return sensor which is located between the consumer and the condenser for measuring the temperature ($T_{return}$) of the heat transfer medium after the heat transfer medium has passed through the consumer.

26. Absorption heat pump as claimed in claim 23, wherein the first control means comprises a supply sensor which is located between the condenser and the consumer for measuring the temperature ($T_{supply}$) of the heat transfer medium which is supplied to the consumer from the condenser.

27. Absorption heat pump as claimed in claim 23, wherein the second control means comprises a temperature sensor for measuring the temperature ($T_{supply}$) of the heat transfer medium emerging from the condenser, a pressure transducer for measuring the pressure ($p_{rcin}$) of the refrigerant entering the condenser, and a controller which adjusts the amount of the refrigerant which is supplied to the vaporizer as a function of the measured pressure and temperature values ($p_{rcin}$, $T_{supply}$).

28. Absorption heat pump as claimed in claim 23, wherein the second control means comprises a first temperature sensor for measuring the temperature ($T_{supply}$) of the heat transfer medium emerging from the condenser, a second temperature sensor for measuring the temperature ($T_{rcout}$) of the refrigerant emerging from the condenser, and a controller which adjusts the amount of the refrigerant which is supplied to the vaporizer as a function of the measured temperature values ($T_{supply}$, $T_{rcout}$).

29. Absorption heat pump as claimed in claim 23, wherein the second control means comprises a first temperature sensor for measuring the temperature ($T_{rcout}$) of the refrigerant emerging from the condenser, a second temperature sensor for measuring the temperature ($T_{hcin}$) of the heat transfer medium entering the condenser, and a controller which adjusts the amount of the refrigerant which is supplied to the vaporizer as a function of the measured temperature values ($T_{rcout}$, $T_{hcin}$,).

30. Absorption heat pump as claimed in claim 23, wherein the third control means comprises a first temperature sensor for measuring the temperature ($T_{rvin}$) of the refrigerant supplied to the vaporizer, a second temperature sensor for measuring the temperature ($T_{rvout}$) of the refrigerant emerging from the vaporizer, and a controller which adjusts the amount of the solution which has been depleted of refrigerant and which is supplied to at least one absorber as a function of the measured temperature values ($T_{rvin}$, $T_{rvout}$,).

31. Absorption heat pump as claimed in claim 23, wherein the third control means comprises a first temperature sensor for measuring the temperature ($T_{rvin}$) of the refrigerant supplied to the vaporizer, a second temperature sensor for measuring the temperature ($T_{mvin}$) of the medium supplied to the vaporizer, and a controller which adjusts the amount of the solution which has been depleted of refrigerant and which is supplied to at least one absorber as a function of the measured temperature values ($T_{rvin}$, $T_{mvin}$,).

32. Absorption heat pump as claimed in claim 24, wherein the third control means comprises a pressure transducer for measuring the pressure ($p_{rvout}$) of the refrigerant emerging from the vaporizer, a temperature sensor for measuring the temperature ($T_{rvout}$) of the refrigerant emerging from the vaporizer, and a controller which adjusts the amount of the solution which has been depleted of refrigerant and which is supplied to at least one absorber as a function of the measured pressure and temperature values.

33. Absorption heat pump as claimed in claim 23, wherein the fourth control means comprises a tank with a level measuring arrangement for determining the level of a liquid which has been added to the tank, a line arrangement for transferring the solution which is rich in refrigerant and which has been diverted from the at least one absorber to the tank; and a controller for adjusting the delivery amount of the solution pump as a function of the measured liquid level.

34. Absorption heat pump as claimed in claim 33, wherein the level measurement arrangement has an inductive float.

* * * * *